US010457475B2

(12) United States Patent
Nickerson et al.

(10) Patent No.: US 10,457,475 B2
(45) Date of Patent: Oct. 29, 2019

(54) CAP ASSEMBLY WITH DISPENSING VESSEL

(71) Applicant: Phoenix Closures, Inc., Naperville, IL (US)

(72) Inventors: Darren Nickerson, Naperville, IL (US); Thomas Stoneberg, Buffalo Grove, IL (US)

(73) Assignee: Phoenix Closures, Inc., Naperville, IL (US)

( * ) Notice: Subject to any disclaimer, the term of this patent is extended or adjusted under 35 U.S.C. 154(b) by 0 days.

(21) Appl. No.: 15/659,167

(22) Filed: Jul. 25, 2017

(65) Prior Publication Data

US 2019/0031424 A1 Jan. 31, 2019

(51) Int. Cl.

| | |
|---|---|
| ***B65D 83/04*** | (2006.01) |
| ***B65D 41/04*** | (2006.01) |
| ***B65D 51/24*** | (2006.01) |
| ***B65D 1/02*** | (2006.01) |
| ***B65D 85/60*** | (2006.01) |

(52) U.S. Cl.

CPC ..... *B65D 83/049* (2013.01); *B65D 1/0246* (2013.01); *B65D 41/04* (2013.01); *B65D 51/24* (2013.01); *B65D 85/60* (2013.01)

(58) Field of Classification Search

CPC ..... B65D 1/0246; B65D 41/04; B65D 51/24; B65D 83/049; B65D 83/0427; B65D 85/60

See application file for complete search history.

(56) References Cited

U.S. PATENT DOCUMENTS 1,333,051 A * 3/1920 Young ..... B65F 1/10 220/252
1,560,013 A 11/1925 Angeletti
2,013,514 A 9/1935 Frank
2,059,135 A * 10/1936 Moe ..... G01F 11/24 222/165
2,104,332 A * 1/1938 Rohde ..... G01F 11/24 222/363
3,045,875 A * 7/1962 Johannesen, Sr. ..... B65D 83/0409 222/364
4,102,477 A * 7/1978 Yoon ..... A47G 19/34 222/438
4,303,172 A * 12/1981 Bosland ..... B65D 43/14 206/305

(Continued)

*Primary Examiner* — Gene O Crawford
*Assistant Examiner* — Kelvin L Randall, Jr.
(74) *Attorney, Agent, or Firm* — Husch Blackwell LLP

(57) ABSTRACT

The invention provides an assembly for dispensing portioned amounts of materials from a container, while keeping the undispensed portions stored within the container, and displaying the dispensed portions for consumption. The cap assembly includes a body member which can reversibly engage the container, and a cap member that transfers predetermined volumes of articles from the interior of a container to a serving vessel that is accessible by an individual consumer, while leaving the remainder of the articles within the container and unavailable to a consumer. The relative position of the body and cap members block or unblock a passageway for dispensing articles through a mouth of the container. The cap member can be used multiple times to dispense additional volumes of articles from the container as desired.

20 Claims, 6 Drawing Sheets

(56) References Cited

U.S. PATENT DOCUMENTS 5,169,036 A * 12/1992 Tong ..... A47G 19/34 222/339
D343,058 S * 1/1994 Allegre ..... D28/73
5,411,186 A 5/1995 Robbins, III
5,413,243 A * 5/1995 Bemis ..... B65F 1/141 206/366
5,487,494 A 1/1996 Robbins, III
5,540,341 A * 7/1996 Holley ..... A47J 43/27 215/11.1
5,542,579 A 8/1996 Robbins, III
5,671,875 A * 9/1997 Robbins, III ..... B65D 47/0866 222/452
5,678,709 A * 10/1997 Holley ..... A47J 43/27 215/11.1
5,881,896 A * 3/1999 Presnell ..... B65F 1/1607 220/252
6,139,802 A * 10/2000 Niermann ..... B01L 3/50825 222/507
6,161,712 A * 12/2000 Savitz ..... B01L 3/50825 215/312
6,164,485 A 12/2000 Hilton
6,267,265 B1 * 7/2001 Issa ..... A61J 7/0076 221/263
6,422,426 B1 7/2002 Robbins, III
6,439,410 B1 8/2002 Dubach
6,920,991 B2 * 7/2005 Holley, Jr. ..... A61J 9/001 206/219
6,929,119 B2 * 8/2005 Shaki ..... B65D 51/24 206/221
9,505,530 B2 * 11/2016 Downey ..... B65D 25/04
2008/0067141 A1 3/2008 Murakami et al.
2008/0093377 A1 * 4/2008 Dadbeh ..... B65D 83/0427 221/288
2010/0206766 A1 * 8/2010 Warman ..... B65D 83/04 206/538
2011/0163118 A1 * 7/2011 Gieda ..... G01F 11/24 222/1
2016/0159555 A1 * 6/2016 Park ..... B65D 83/049 221/175

* cited by examiner

CAP ASSEMBLY WITH DISPENSING VESSEL

BACKGROUND OF THE INVENTION

Many small articles are sold in quantities much larger than are typically consumed or used at a single time. Typically, individual portions are dispensed from a large container and transferred to a serving vessel. There is a need for closure assemblies that can dispense limited amounts of such articles and can function as a receptacle to present those pre-portioned amounts of articles to consumers while simultaneously keeping the remaining articles within the container and out of reach to the consumers.

For example, it can be desirable to purchase small articles like food items, such as candy, in large quantities and dispense portions or fractions of the total quantity at any time. It can be desirable to limit the amount of food items exposed to the environment, dispensing only the quantity desired for immediate consumption while keeping the remainder stored in the container. Such a feature could preserve the freshness and security of the undispensed portion of items from air, moisture, insects, and vermin.

It can be desirable to limit the amount of food items made available to consumers at a given time, to discourage over-indulgence by the consumers or to simply control the rate at which the food item is dispensed.

It can be desirable to store undispensed items in close proximity to a dispensing vessel, making the refill process faster and more convenient, while ensuring that the undispensed items are kept retained within the container. Attaching a refill container to a dispensing vessel can minimize the risk of inadvertently substituting the wrong item when attempting to refill the dispensing vessel.

It can be particularly convenient for a cap assembly to dispense portioned amounts of flowable materials from a container while leaving the remaining materials within the container where they are out of reach of consumers, and to provide a serving or display vessel for the dispensed materials. It is particularly desirable for such a cap assembly to be readily used multiple times to repeatedly replenish the serving vessel with previously-undispensed materials from the container.

SUMMARY OF THE INVENTION

This invention relates to a cap and closure assembly for dispensing articles, such as candy, tablets, buttons, novelties, and other solid or flowable items typically stored in large quantities in containers. It particularly relates an assembly that can dispense the a fraction of the stored articles in predetermined amounts or portions from the container in which they are stored, while ensuring that the undispensed portion remains within the container and separated from the dispensed portion, and can present the dispensed articles in a manner accessible to users. In particular, a bowl-shaped dispenser is used to collect portions of the articles and to provide a serving vessel for presenting the articles, while also preventing the undispensed portions from escaping the container prematurely.

The present invention relates generally to a cap assembly for dispensing an article from a container, comprising: i) a body member including a peripheral rim for fitting onto the container, a skirt for reversibly engaging a neck of the container, and a quarter-spherical scoop obstructing a portion of the mouth, the quarter-spherical scoop having a passageway communicating with an interior of the container; a pair of pivot recesses located at diametrically opposite points on an edge of the quarter-spherical scoop; and ii) a cap member including a hemispherical bowl positioned within the quarter-spherical scoop, the hemispherical bowl having an outside diameter smaller than an inside diameter of the quarter-spherical scoop; a peripheral border around an edge of the hemispherical bowl, the peripheral border including an outward extending lip, the lip contacting the peripheral rim at a first contact point when the cap member is in a closed configuration, and the lip engaging the peripheral rim near a second contact point substantially diametrically opposite the first contact point when the cap member is in a opened configuration; and a pair of pivot portions for engaging the pivot recesses, the pivot portions rotatably supporting the hemispherical bowl for movement through an angle of about 180 degrees about an axis extending between the pivot recesses; where in the closed position, the hemispherical bowl and quarter-spherical scoop align so that the passageway is obstructed by the hemispherical bowl and the mouth is obstructed by the cap assembly, and where in the open position, the hemispherical bowl and quarter-spherical scoop align so that the passageway and the mouth of the container align to create an opening for dispensing the article from the container.

An aspect of the cap assembly relates to a first contact point including a depression for receiving the lip.

An aspect of the cap assembly relates to the peripheral rim and the peripheral border being substantially coplanar when the cap member in the closed configuration.

An aspect of the cap assembly relates to cap assembly with a profile with a substantially flat top surface when in the closed configuration and a convex profile when in the cap assembly is in the opened configuration.

An aspect of the cap assembly relates to an interior surface of the quarter-spherical scoop comprising a groove between the edge of the quarter-spherical scoop and the passageway.

An aspect of the cap assembly relates to the hemispherical bowl comprising substantially three-quarters of a spherical surface.

An aspect of the cap assembly relates to the edge of the hemispherical bowl comprising a flared extension, the flared extension not directly contacting the hemispherical bowl.

An aspect of the cap assembly relates to the passageway located substantially on one side of the axis extending between the pivot recesses.

The present invention also relates generally to a cap assembly for dispensing an article from a container, comprising: i) a body member for being reversibly mounted over the mouth the container including a peripheral rim for fitting onto the container, a skirt depending substantially perpendicular from an exterior edge of the peripheral rim, the skirt for engaging the container, a concave recess depending from an interior edge of the peripheral rim, the concave recess partially blocking the mouth and having a passageway communicating with an interior of the container, and a pair of pivot recesses located at diametrically opposite points on an edge of the concave recess; and ii) a cap member comprising: a concave bowl nested within the concave recess when the container is in an upright storage position, the concave bowl substantially not contacting the concave recess when the container is in an inverted dispensing position; a peripheral border around an edge of the concave bowl, the peripheral border including a protruding lip, the lip contacting the peripheral rim at a first contact point when the container is in the upright storage position and engaging the peripheral rim at a second contact point substantially diametrically opposite the first contact point when the container is moved to the inverted dispensing position; and a pair of pivot portions for engaging the pivot recesses, the pivot portions rotatably supporting the concave recess for rotational movement about an axis extending between the pivot portions; wherein the container in the upright storage position effects an engagement between the peripheral border and the peripheral rim with the lip contacting the first contact point, and the concave bowl obstructs the passageway; and wherein the container in the inverted dispensing position effects an engagement between the lip and the second contact point, and positions the concave recess so that the passageway provides an opening between the interior of the container and the interior surface of concave bowl for dispensing the article from the container.

An aspect of the cap assembly relates to the concave recess having a compartment into which an article is receivable by movement of the container from the upright storage position to the inverted dispensing position.

An aspect of the cap assembly relates to the article being accessible to a user by movement of the container from the inverted dispensing position to the upright storage position.

An aspect of the cap assembly relates to the movement of the container being a rotational movement.

An aspect of the cap assembly relates to the peripheral rim includes a receiving portion configured to accept the protruding lip.

An aspect of the cap assembly relates to the cap member having a profile with a substantially flat top surface when the lip contacts the peripheral rim at a first contact point.

An aspect of the cap assembly relates to the cap member having a profile with a substantially flat top surface when the lip contacts the peripheral rim at a first contact point and a convex profile when the lip engages the peripheral rim at the second contact point.

An aspect of the cap assembly relates to the concave bowl comprising a groove.

An aspect of the cap assembly relates to the concave recess comprising a ridge that engages the groove.

An aspect of the cap assembly relates to the concave bowl comprising an extension flaring away from the peripheral rim.

An aspect of the cap assembly relates to the first contact point being located between the pivot portions.

An aspect of the cap assembly relates to the an edge of the passageway being defined by a portion of an interior edge of the peripheral rim

BRIEF DESCRIPTION OF THE DRAWINGS

The features of the present invention which are believed to be novel are set forth with particularity in the appended claims. The drawings may not be to scale. The invention can best be understood by reference to the following description taken in conjunction with the accompanying drawings.

DETAILED DESCRIPTION OF THE INVENTION

Figure 1A:
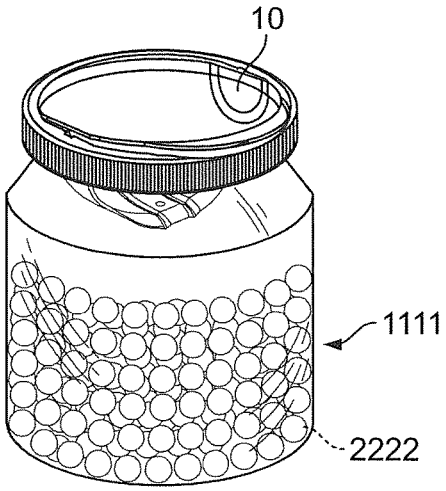
FIGS. 1A and 1B show a view of an embodiment of a cap assembly engaging a container and an exploded perspective view of an embodiment of the container with the cap assembly, respectively.

While the present invention is susceptible of embodiments of various forms, there is shown in the drawings, and will hereinafter be described some exemplary and non-limiting embodiments, with the understanding that the present disclosure is to be considered an exemplification of the invention. It is not intended to limit the invention to the specific embodiments listed.

Figure 1B:
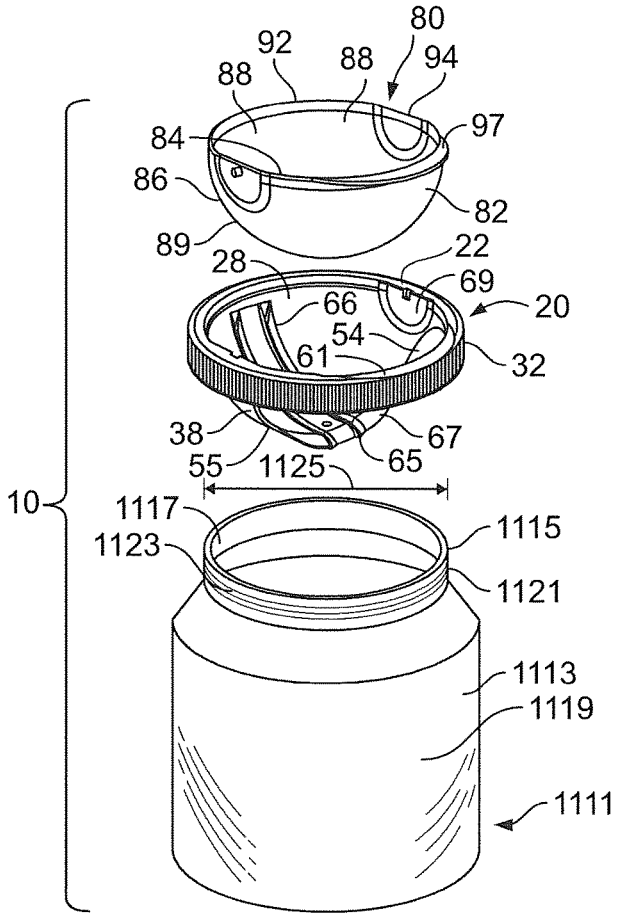

As shown generally in FIGS. 1-6, and particularly in FIGS. 1A-1B, a cap assembly 10 is used to dispense articles 2222 from a container 1111 that typically contains quantities of the articles 2222. Typically, the container 1111 can have an interior portion 1119 containing one or more articles 2222, for example, gumballs, jelly beans, or other types of candy. At one end, such a container 1111 typically has a neck 1115, usually for accommodating a closure or lid, and a mouth 1117 for dispensing the articles 2222 stored within the container 1111.

When an article 2222 is transferred into the cap assembly 10 and available to be dispensed to an individual or consumer, the article 2222 can occupy a location that is simultaneously within the interior 1119 of the body 1113 of the container 1111 and within the cap assembly 10. Because the article can thus be touched or accessed by the individual, the article is then considered to be a "dispensed article," compared to the articles that are out of the consumer's reach at that same time, which are considered "undispensed articles."

As shown in FIGS. 2-6, the body member 20 can comprise a peripheral rim 22 that that defines the upper surface 24 or top wall of the body member 20. The peripheral rim 22 can define a diameter 52 of the body member 20 and can be used to align the cap assembly 10 along the mouth of the container 1111. The interior surface 28 of the peripheral rim 22 can contact the outer edge of the neck 1115 of the container 1111. The interior surface 28 of the peripheral rim 22 can be interior in the sense that when the cap assembly 10 is affixed to the container 1111, the interior surface 28 is not exposed or accessible to an individual using the container 1111 and cap assembly 10.

The body member 20 can include a skirt 32 that depends from the peripheral rim 22, preferably from an outer perimeter 35 of the peripheral rim 22. In some embodiments, the skirt 32 depends at a substantially right angle to the peripheral rim 22. The skirt 32 can cooperate with the container 1111, typically with the neck 1115 of the container 1111, to engage the container 1111 to form a connection that can be reversed to unseal that connection to remove the cap assembly 10 from the container 1111.

Figure 5A:
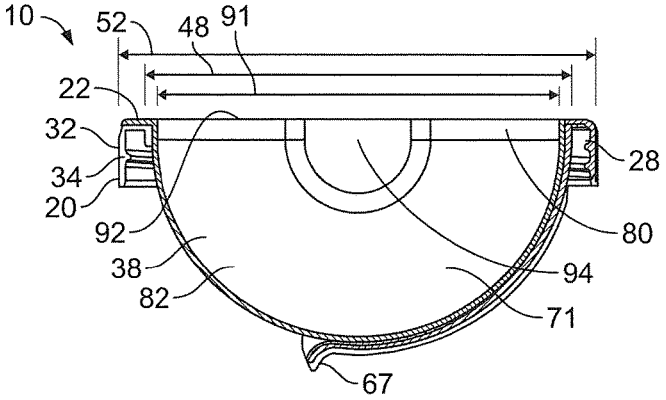
FIGS. 5A-5C show a cap assembly in the closed configuration, in cross-section (FIG. 5A) and from a front view with partial cutaway (FIG. 5B), and a focused view of the attachment of a cap assembly to a container (FIG. 5C)
Figure 5B:
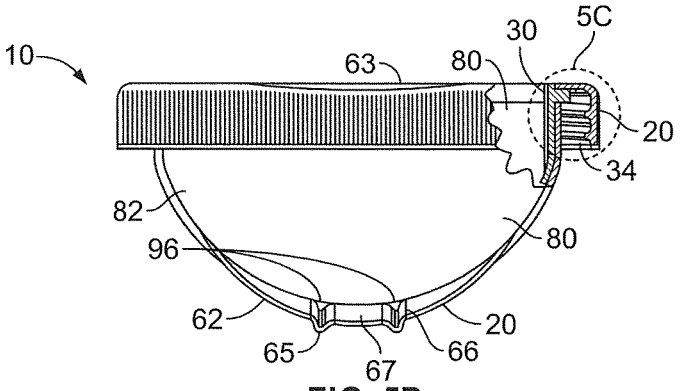
Figure 5C:
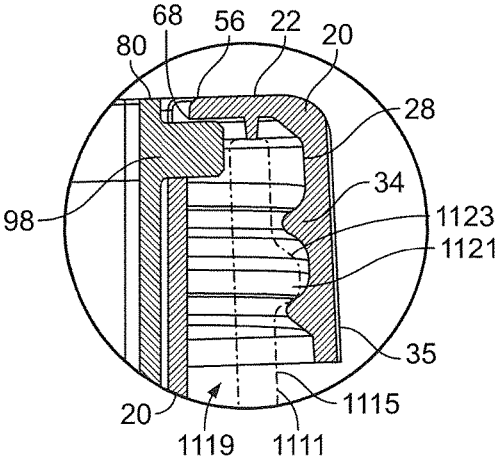

Any commonly used connection means 1121 can be used to effect the reversible seal or engagement. For example, as shown in FIGS. 5A-5C, the skirt 32 can comprise an internal thread 34 adapted to cooperate with an external thread 1123 on the neck 1115 of the container 1111. Alternatively, the skirt 32 can have a snap fit means onto (or otherwise suitably attached) to the container 1111, hinged by a pin, or other suitable connecting means 1121 to effect the connection between the cap assembly 10 and the container 1111.

As shown in FIGS. 2B-2C and 4A-4B, the body member 20 can comprise a panel 36 in a dome-shape that includes a quarter-spherical scoop 38 or hemispherical scoop that can depend or extend from an inner perimeter 42 of the peripheral rim 22, to create a rounded structure 44 or compartment. With respect to their connections to the peripheral rim 22, the hemispherical scoop 38 and the skirt 32 can depend in the same direction away from the outer surface 35 of the peripheral rim 22. The interior surface 28 of the peripheral rim 22 can separate the skirt 32 from the hemispherical scoop 38 and prevent them from touching.

The hemispherical scoop 38 can comprise a hemispherical portion 46 that passes through the mouth of the container 1111 and extends into the interior 1119 of the container 1111. When the cap assembly 10 is engaged onto the container 1111, a portion of the hemispherical scoop 38 can be located within the container 1111; thus, the diameter 48 of the hemispherical scoop 38 can be smaller than the diameter 1125 of the mouth of the container 1111, while the diameter 52 of the skirt 32 can be larger than the diameter 1125 of the mouth.

Figure 2B:
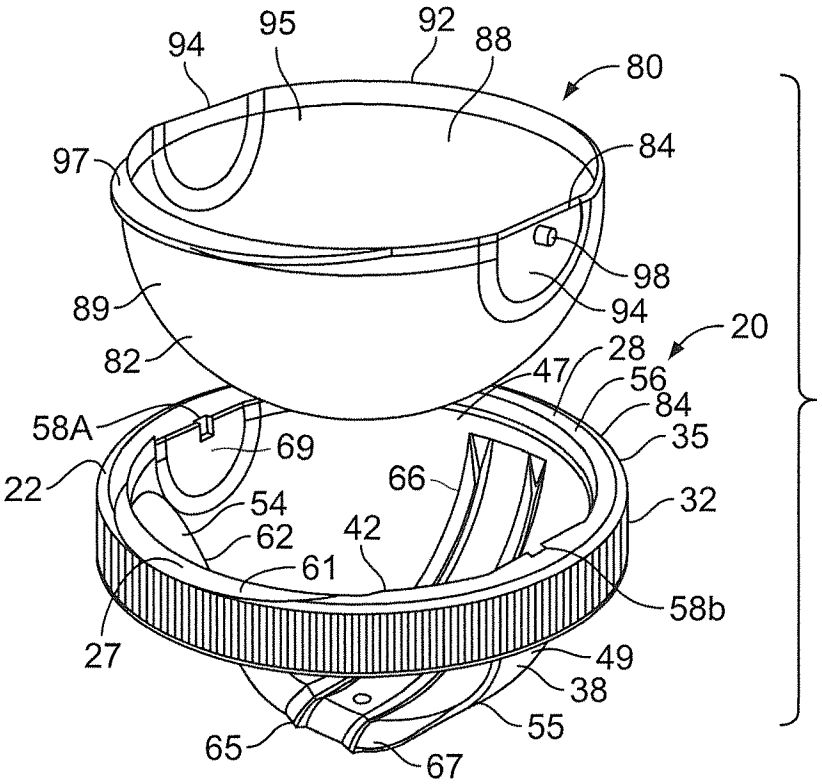
FIGS. 2A and 2B show exploded views of a cap assembly from the rear and the front, respectively.
Figure 2A:
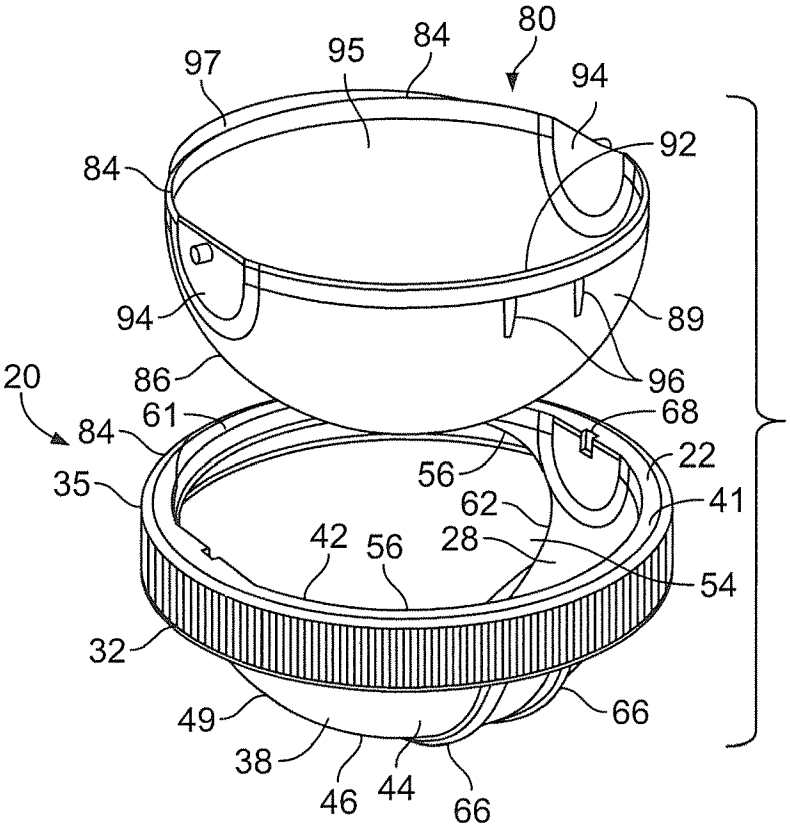
Figure 3A:
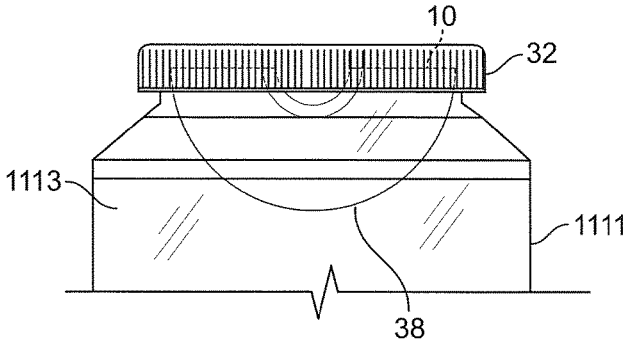
FIGS. 3A-3C illustrate front views of a cap assembly engaging a container in the closed configuration (FIG. 3A), and a cap assembly that is in the open configuration, viewed from the front (FIG. 3B) and from the side (FIG. 3C)

As shown in FIG. 3A, the hemispherical scoop 38 can include an opening or passageway 54 that communicates with the interior 1119 of the container 1111. As shown in FIGS. 2B, 4A-4B, and 6B-6C in preferred embodiments, one edge 56 of the passageway 54 is defined by a portion of an interior edge 56 of the peripheral rim 22, between two points 58*a*, 58*b* on the peripheral rim 22. Another edge 62 of the passageway 54 can be defined by a line drawn across the hemispherical scoop 38 between those two points 58*a*, 58*b* and face the interior 1119 of the container 1111, abutting a portion of the hemispherical scoop 38. Thus, as shown in FIGS. 2A-2B, the passageway 54 can be oriented to one side of the hemispherical scoop 38 as an alternative to being centrally located around a longitudinal axis of the container 1111 or the central portion 64 of the hemispherical scoop 38 extending furthest into the interior 1119 of the container 1111 or furthest away from the upper surface 24 of the body member 20.

Figure 6A:
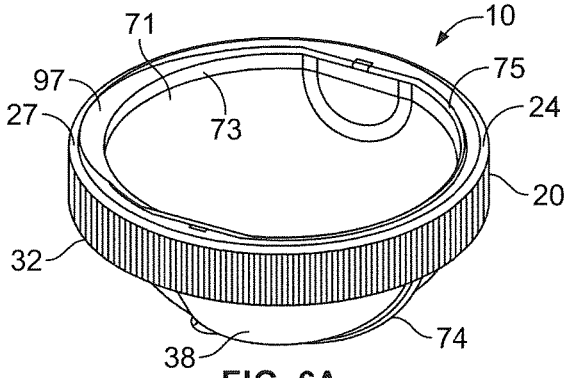
FIGS. 6A-6C shows a top perspective view, top view, and bottom view of a cap assembly in the closed configuration, respectively.
Figure 6B:
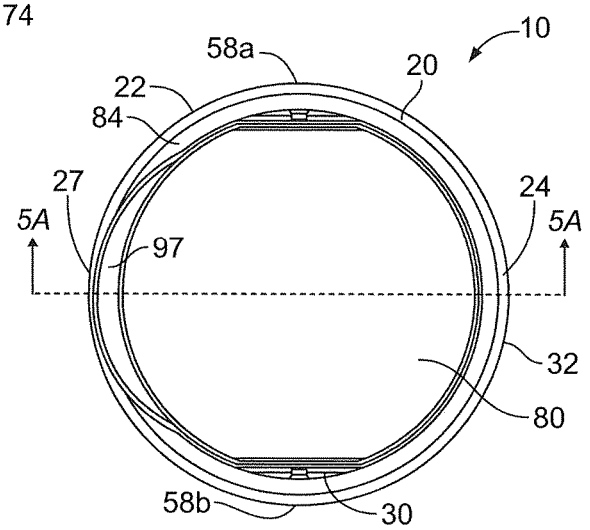
Figure 6C:
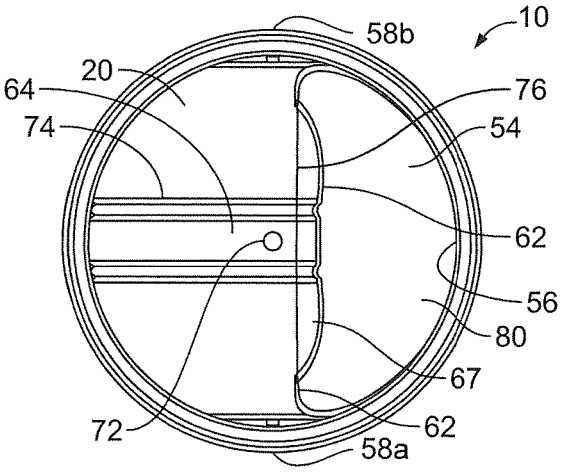

As shown in FIGS. 6A-6C, if the hemispherical scoop 38 were analogized to the southern hemisphere 71 of the Earth or a globe with a southern pole 72, a portion of the outer edge 55 of the passageway 54 could be defined as running along a portion of the equator 73, while another portion of the outer edge 62 generally runs in a longitudinal line 74 across the southern hemisphere 71 at the outermost points of the equatorial edge 75. That is, the passageway 54 can cross or contact the equator 73, or be located in a portion of the southern hemisphere 71 that does not include the equator 73 or the pole 72. In some embodiments, the equatorial edge 75 and the longitudinal edge 76 can meet at a substantially right angle; in other embodiments, a curvilinear edge can join an equatorial edge 75 to a longitudinal edge 76. The passageway 54 can form a regular geometric shape, a rounded outline, or an irregular shape. In preferred embodiments, the passageway 54 comprises a generally symmetrical opening that lacks sharp edges or protrusions that interfere with or impede the flow of articles 2222 from the container 1111.

In some embodiments, the hemispherical scoop 38 can comprise between about one-eighth to seven-eighths of a dome containing the hemispherical scoop 38; in some embodiments the hemispherical scoop 38 can comprise about between one-half to three-eighths of a dome; in a preferred embodiment, the hemispherical scoop 38 can comprise about three-eighths of a dome and contain an intact southern pole 72.

To enhance the ability of the hemispherical scoop 38 to collect one or more articles 2222, the hemispherical scoop 38 can comprise one or more ridges 65 in its exterior surface 49. Such a feature can encourage the movement of an article 2222 around the exterior surface 49 of the hemispherical scoop 38 when the article 2222 is dispensed from the container 1111. The hemispherical scoop 38 can comprise one or more grooves 66 or furrows on its interior surface 47, to encourage the movement of an article 2222 around the interior of the hemispherical scoop 38 when the article 2222 is dispensed from the container 1111.

The hemispherical scoop 38 can comprise an outwardly extending member 67 along a portion of its edge 62. For example, a flared extension 67 can extend downward and outward, generally way from the peripheral rim 22, from a portion of the hemispherical scoop 38 in its south polar region, at an obtuse angle to encourage the flow of an article 2222 from the hemispherical scoop 38.

The hemispherical scoop 38 can comprise one or more recesses for accommodating a pivot means 30 for connecting the cap member 80 to the body member 20. As shown in FIGS. 2A-2B and 6A-6B, embodiments of the invention can comprise a pair of pivot recesses 68 configured to receive corresponding pivot portions 98 in the cap member 80, thus serving as a pivot means 30 for the cap assembly 10. In these figures, the pivot recesses 68 can be located at diametrically opposite points of the peripheral rim 22, where the interior edge 56 of the peripheral rim 22 joins the hemispherical scoop 38.

In some preferred embodiments, a line drawn between the pivot recesses 68 along the hemispherical scoop 38 runs through the south pole 72 of the hemispherical scoop 38. In some particularly preferred embodiments, the passageway 54 can be located entirely on one side of that line between the pivot recesses 68 along the hemispherical scoop 38 runs through the south pole 72 of the hemispherical scoop 38.

When one or more articles 2222 are dispensed from the container 1111, the hemispherical scoop 38 can partially block the mouth of the container 1111, partially blocking the flow of the articles 2222 and decreasing the movement rate of the articles 2222 out of the container 1111. Instead of flowing from the interior 1119 of the container 1111 directly out of the mouth, the articles 2222 can first pass through the passageway 54 before exiting the container 1111 through the mouth.

Figure 3B:
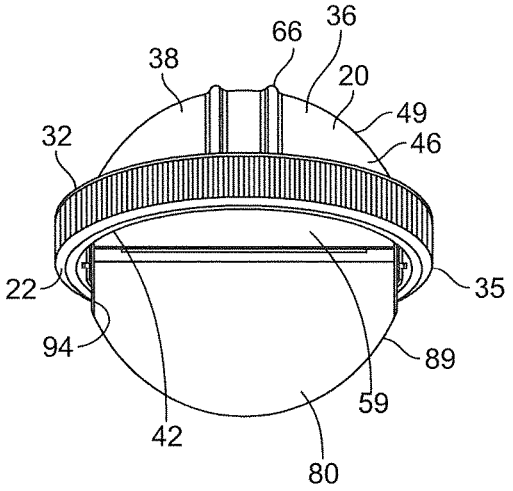
Figure 3C:
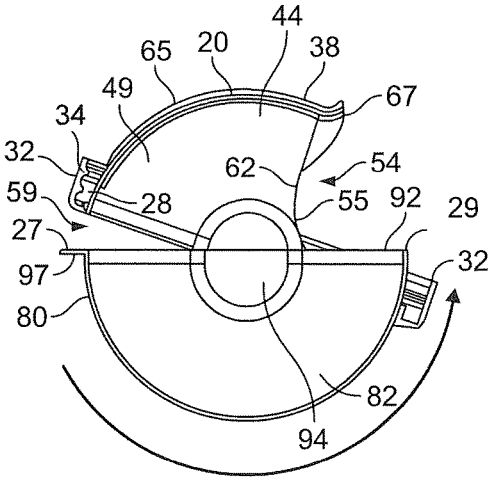

As shown in FIGS. 3A-3C, the cap assembly 10 can include a cap member 80 comprising a hemispherical bowl 82 with a peripheral border 84 around its upper edge 92, and a pivot portion 98 for engaging the pivot recess 68 of the body member 20.

The hemispherical bowl 82 can comprise a panel 86 in a substantially domed shape to provide a rounded space or a compartment 88. The hemispherical bowl 82 can serve as serving vessel or dish for holding and displaying one or more articles 2222 transferred from storage in the interior 1119 of the container 1111 to the exterior of the container 1111. The hemispherical bowl 82 can serve as a dipper or instrument to collect an article 2222 from the interior 1119 of the container 1111 when the cap assembly 10 is engaged in a position for transferring articles 2222 from the interior 1119 of the container 1111. In some configurations, the cap assembly 10 can serve as a vessel for dispensing that article 2222 to an external user or consumer when the cap assembly 10, and serve as a barrier blocking the mouth of the container 1111 to prevent the comingling of dispensed articles with undispensed articles.

The hemispherical bowl 82 has an exterior surface 89 with a diameter 91 that can be smaller than the diameter 48 of the interior surface 47 of the hemispherical scoop 38 of the body member 20. The hemispherical bowl 82 can be nested within the hemispherical scoop 38. It is preferred that the difference in the two diameters 48, 91 be great enough to allow the hemispherical bowl 82 to rotate inside the hemispherical bowl 82, but small enough that the exterior surface 89 of the hemispherical bowl 82 can contact the interior surface 47 of the hemispherical scoop 38.

The hemispherical bowl 82 can have an upper edge 92 that can run beside or along the interior edge 56 of the peripheral rim 22 when the hemispherical bowl 82 serves as a dispensing vessel. The upper edge 92 of the hemispherical bowl 82 can be nested within the interior edge 56 of the peripheral rim 22; the two structures can be contiguous and follow a common boundary. That common boundary can describe a substantially circular path; in some embodiments, the path can deviate to accommodate indentations 94 in the hemispherical bowl 82.

As shown in FIGS. 6A-6C, the hemispherical bowl 82 can be generally bowl-shaped or in the general shape of a dome. The hemispherical bowl 82 can comprise one or more indentations 94 that contain the one or more pivot portions 98 that connect the hemispherical bowl 82 to the hemispherical scoop 38. Each indentation 94 can introduce a flat contour in the otherwise round hemispherical bowl 82, as the location of the pivot portions 98 (i.e., rod or hinge); this feature can result in a hemispherical bowl 82 with an upper edge 92 that describes a generally circular path with straightened portions that is generally oval or egg-shaped. The indentations 94 can break up the otherwise circular upper edge 92, guiding and aligning the pivot portions 98 for easier insertion into corresponding indentations 69 along the corresponding pivot recesses 68. In embodiments lacking such indentations 94, the pivot portions 98 can be located at diametrically opposite points of each other on the exterior surface 89 of the hemispherical bowl 82, where the upper edge 92 of the hemispherical bowl 82 meets the interior edge 56 of the peripheral rim 22.

In some embodiments, the exterior surface 89 of the hemispherical bowl 82 is generally smooth, to facilitate the rotational movement of the hemispherical bowl 82. In some embodiments, the exterior surface 89 can comprise one or more ridges 96. The ridge 96 can begin at the upper edge 92 of the hemispherical bowl 82; in particular embodiments, those ridges 96 align with one or more corresponding grooves 66 in the interior surface 47 of hemispherical scoop 38. The ridges 96 and grooves 66 can be oriented to describe paths along the hemispherical bowl 82 and the hemispherical scoop 38 that are generally perpendicular to an axis defined by the line drawn between the pivot recesses 68 along the hemispherical scoop 38 or generally perpendicular to an axis defined by the line drawn between the pivot points along the hemispherical bowl 82. These ridges 96 and grooves 66 can be aligned to discourage or prevent the hemispherical bowl 82 and hemispherical scoop 38 from the movement in directions other than the rotation allowed by the pivot means 30 (pivot portions 98 engaged in the pivot recesses 68).

Figure 4B:
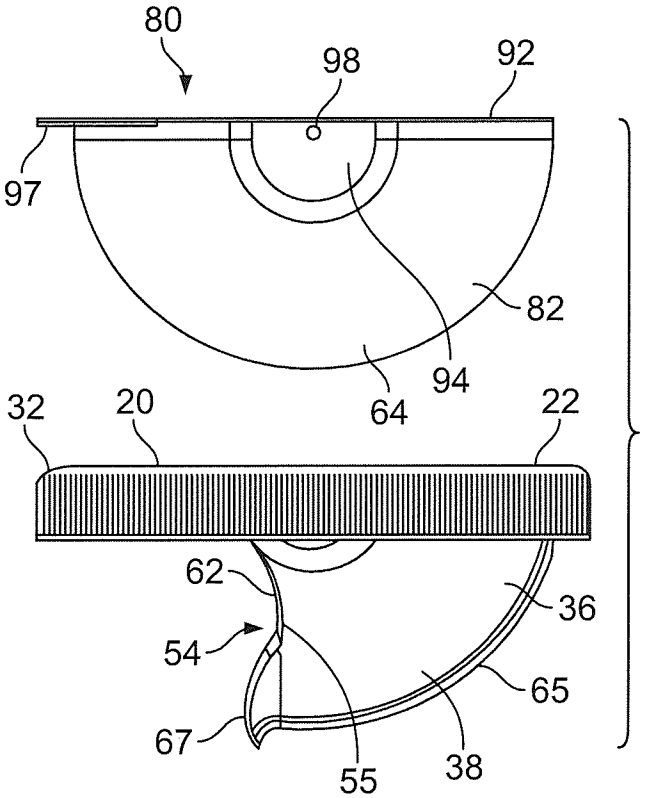
FIGS. 4A-4B shows exploded views of a cap assembly from a rear view (FIG. 4A) and from a side view (FIG. 4B)
Figure 4A:
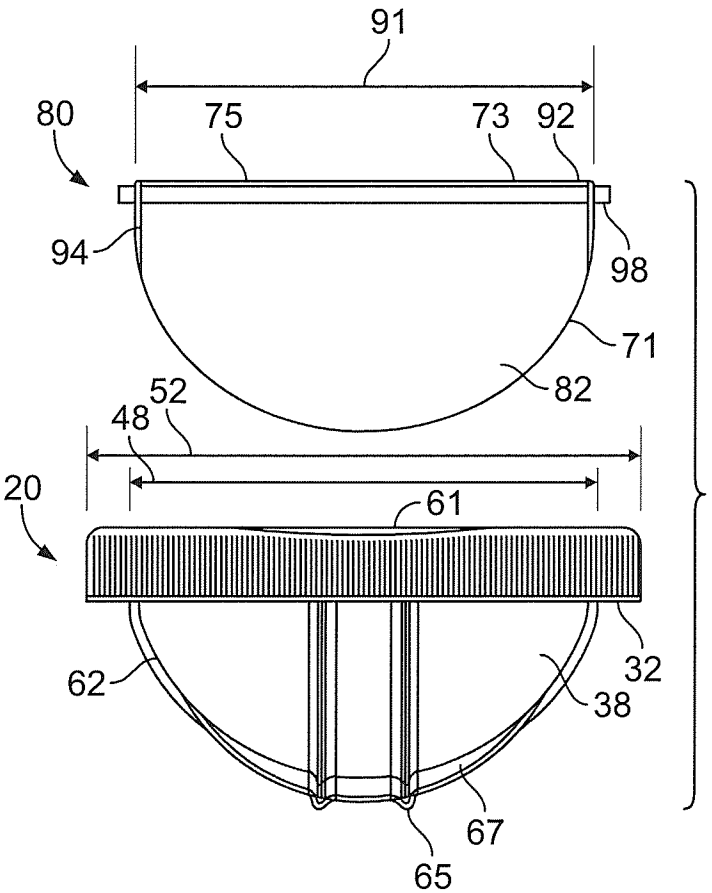

As shown in FIGS. 4A and 5E, some embodiments can include ridges 96 on the hemispherical bowl 82 that cooperate or engage with grooves 66 on the hemispherical scoop 38. Some embodiments can include ridges 65 on the hemispherical scoop 38 cooperating with grooves on the hemispherical bowl 82. Some embodiments can include both features or include other features for guiding the cooperative movement between the hemispherical bowl 82 and hemispherical scoop 38.

As shown in FIGS. 5A-5C, the hemispherical bowl 82 can comprise a pivot means 30 for connecting or engaging with the body member 20 to allow that hemispherical bowl 82 to rotate around an axis defined by either the pivot recesses 68 or the pivot portions 98. Like the pivot recesses 68, the pivot portions 98 can be located at diametrically opposite points of each other, the pivot portions 98 on opposite points on the exterior surface 89 of the hemispherical bowl 82, where the upper edge 92 of the hemispherical bowl 82 meets the interior edge 56 of the peripheral rim 22. Each pivot portion 98 can be inserted into or configured with a pivot recess 68 to provide a pivotal engagement between the body member 20 and the cap member 80.

In preferred embodiments, the pivot recesses 68 and pivot portions 98 define the same axis. The pivot portions 98 can be configured with the pivot recesses 68 to support the rotational movement of the hemispherical bowl 82. In some embodiments, the hemispherical bowl 82 can move through an angle of about 180 degrees about the axis extending between the pivot means 30 (e.g., the pivot portions 98 or the pivot recesses 68) as the cap member 80 moves between an open configuration and a closed configuration. As the hemispherical bowl 82 rotates around the pivot means 30, the exterior surface 89 of the hemispherical bowl 82 can slidingly contact the interior surface 47 of the hemispherical scoop 38.

Although preferred embodiments include a pivot means 30 for attaching or connecting the body member 20 to the cap member 80, it is understood that other means of attachment are envisioned, as understood in the art.

As shown in FIGS. 2A-2B and 3A-3C, the hemispherical bowl 82 can comprise a protruding or outward extending lip 97 that extends to the exterior edge of the peripheral rim 22. The lip 97 can be moved or manipulated by a user to convert the cap assembly 10 from one position for collecting articles 2222 from the container 1111 to another position for displaying the collected articles and sequestering them from uncollected articles remaining inside the container 1111.

The lip 97 can contact the peripheral rim 22 at a first contact point 27 when the cap member 80 is in the closed configuration and the lip 97 can contact the peripheral rim 22 at a second contact point 29 when the cap member 80 is in the closed configuration. The first and second contact points 27, 29 can be positioned or located substantially diametrically opposite each other on the peripheral rim 22.

The peripheral rim 22 can comprise a receiving portion 61 or indentation contoured to receive the outward extending lip 97 when the cap member 80 is in the opened configuration. The peripheral rim 22 can comprise a depression 63, such that the outward extending lip 97 nears, but does not touch the peripheral rim 22 when the cap member 80 is in the closed configuration, thus providing a channel 59 for users' fingers or fingertips for gripping or the tip of an instrument for prying to facilitate moving the cap member 80 from the closed configuration to the open configuration.

The body member 20 and cap member 80 can be molded from a variety of plastics. In some embodiments, the body member 20 and/or cap member 80 can be manufactured from a rigid or substantially inflexible material.

The body member 20 and the cap member 80 can be separately fabricated and thereafter assembled. This assembly can be accomplished causing the pivot portions 98 to engage the pivot recesses 68, such that the exterior surface 89 of the hemispherical bowl 82 contacts the interior surface 47 of the hemispherical scoop 38; it is preferred that the two surfaces be substantially contiguous when the cap member 80 is in the closed position.

In some embodiments, the cap assembly 10 can be positioned onto the container 1111 by aligning the interior surface 28 of the peripheral rim 22 against the neck 1115 of the container 1111, so as to position the hemispherical scoop 38 within the mouth 1117 of the container 1111. The cap assembly 10 can form an engagement with the container 1111, such as by the engagement of an internal thread 34 of the skirt 32 with an external thread 1123 on the neck 1115 of the container 1111. Such engagement can be reversed to allow the removal of the cap assembly 10 from the container 1111. When engaged, the cap assembly 10 can be in a closed position that exposes the interior surface 95 of the hemispherical bowl 82 to the environment outside the container 1111 and leaves the exterior surface 89 of the hemispherical bowl 82 facing and blocking the mouth 1117 of the container 1111.

In some embodiments, when the cap assembly 10 is in the closed position, the lip 97 of the hemispherical bowl 82 can engage the peripheral rim 22 at the first contact point 27 and when the cap assembly 10 is in the open position, the lip 97 of the hemispherical bowl 82 can engage the peripheral rim 22 at a second contact point 29, usually at the point farthest from the first contact point 27.

In some embodiments, when the container 1111 is in an upright resting configuration with the cap member 80 in an open position, the engaged cap assembly 10 can have a profile wherein the top surface of the cap assembly 10 can be generally flat, with the hemispherical scoop 38 and hemispherical bowl 82 passing through the mouth 1117 and coming to rest positioned within the interior 1119 of the container 1111. When the cap member 80 is in the open position, the hemispherical bowl 82 is positioned against the hemispherical scoop 38 so that the hemispherical bowl 82 obstructs the passageway 54 of the hemispherical scoop 38; thus, the mouth 1117 of the container 1111 is blocked and articles 2222 cannot pass through the mouth 1117 when the cap member 80 is in the open configuration.

When the cap member 80 is in the closed position, the engaged cap assembly 10 can have a profile with a generally convex or domed shape defined by the shape of the hemispherical bowl 82. When the cap member 80 is in the open position, the hemispherical bowl 82 is positioned against the hemispherical scoop 38 so that the hemispherical bowl 82 no longer contacts or blocks the passageway 54 of the hemispherical scoop 38; thus, the mouth 1117 of the container 1111 is partially opened and articles 2222 pass through the mouth 1117 when the cap member 80 is in the open configuration.

To dispense an article 2222 from the container 1111, the container 1111 can be rotated around the cap assembly 10 in a series of substantially 180 degree rotations while the cap member 80 is maintained in a level position such that the plane defined by the upper edge 92 of the hemispherical bowl 82 remains substantially horizontal. The hemispherical bowl 82 can remain stationary while an article 2222 dispensed from the container 1111.

After the cap assembly 10 is connected to the container 1111, the container 1111 can be placed in an upright position with the cap member 80 in the closed position. The container 1111 is rotated approximately 180 degrees to be inverted, while the hemispherical bowl 82 can remain stationary and unmoving during the manipulation of the container 1111 and the body member 20.

In this configuration, the hemispherical scoop 38 of the body member 20 can describe or define a concave recess depending substantially perpendicular from an interior edge 56 of the peripheral rim 22. That hemispherical scoop 38 can block a portion of the mouth 1117 of the container 1111. In some embodiments, the hemispherical scoop 38 can block at least one quarter, one third, one half, two thirds, or three quarters of the mouth 1117. The passageway 54 of the hemispherical scoop 38 provides a pathway for articles 2222 to be dispensed from the container 1111 when the passageway 54 and the mouth 1117 are aligned to provide an opening through the hemispherical scoop 38 into the interior 1119 of the container 1111.

The cap member 80 can include a concave portion or hemispherical bowl 82 that can be positioned with respect to the hemispherical scoop 38 so that the structures, in concert forming a substantially continuous barrier, block or obstruct the mouth 1117 of the container 1111 and prevent the movement of an article 2222 into or out of the container 1111. In this configuration, the hemispherical bowl 82 can be positioned to obstruct the passageway 54 of the hemispherical scoop 38.

The hemispherical bowl 82 and hemispherical scoop 38 can also be positioned to facilitate the flow of an article 2222 into or out of the mouth 1117 of the container 1111. The structures can be aligned so that the entire edge 55 of the passageway 54 contacts the hemispherical bowl 82 and that the hemispherical bowl 82 obstructs the flow of articles 2222 through the passageway 54.

When the container 1111 is rotated about an axis defined by the pivot means 30 of the cap assembly 10 and the hemispherical bowl 82 is kept stationary, and the hemispherical scoop 38 can rotate in the same direction and around the same axis of rotation as the container 1111. The hemispherical scoop 38 can move from the closed position to the open position when the lip 97 is moved from the first contact point 27 to the second contact point 29. In this configuration, the passageway 54 can be oriented or positioned so that the mouth 1117 becomes partially cleared or unobstructed. The articles 2222 can travel through the passageway 54 and through the mouth 1117 of the container 1111 into the interior surface 95 of the hemispherical bowl 82. This change in configuration can be reversed by moving the hemispherical scoop 38 from the second contact point 29 to the first contact point 27.

When the container 1111 is returned to an upright position, taking the same path of rotation in reverse, the hemispherical scoop 38 moves and blocks the passageway 54 so that the mouth 1117 can be fully blocked, stopping the outflow of articles 2222 from the container 1111. The lip 97 moves from the second contact point 29 to its original location at the first contact point 27, yielding a hemispherical bowl 82 holding a pre-determined amount of articles 2222 from the container 1111, with the remaining articles 2222 still residing within the container 1111.

The cap assembly 10 can reversibly move between open and closed configurations for repeatedly dispensing articles 2222 from the container 1111, or for adding articles 2222 into the container 1111. For example, the cap assembly 10 could be used to dispense predetermined quantities of candy. When the candy is consumed, the cap assembly 10 can be employed to replenish the candy display quickly and easily. Because the cap assembly 10 provides a lid or covering for the container 1111 of candy, the container 1111 can be kept in close proximity to the place where the candy is dispensed, removing the need for searching for, and attaching, the container 1111 when refills are desired.

Although candy is cited as one example of an article 2222 that can be dispensed and displayed by the cap assembly 10, it is envisioned that other flowable materials can be accommodated, including, but not limited to things like grains, seeds, nuts, spices, powders, buttons, toys, coins, tokens, and novelties.

The present invention is not limited to the particular details of the embodiments depicted, and other modifications and applications are contemplated. Certain other changes can be made in the above-described method without departing from the true spirit and scope of the invention herein involved. It is intended, therefore, that the subject matter in the above depiction shall be interpreted as illustrative and not in a limiting sense.

What is claimed is:

1. A cap assembly for dispensing an article from a container having a mouth, comprising:

a body member comprising:

a peripheral rim for fitting onto the container;

a skirt for reversibly and sealably engaging a neck of the container; and a quarter-spherical scoop obstructing a portion of the mouth, the quarter-spherical scoop having a passageway communicating with an interior of the container;

a pair of pivot recesses located at diametrically opposite points on an edge of the quarter-spherical scoop; and a cap member comprising:

a hemispherical bowl positioned within the quarter-spherical scoop, the hemispherical bowl having an outside diameter smaller than an inside diameter of the quarter-spherical scoop;

a peripheral border around an edge of the hemispherical bowl, the peripheral border including an outward extending lip, the lip contacting the peripheral rim at a first contact point when the cap member is in a closed configuration, and the lip engaging the peripheral rim near a second contact point substantially diametrically opposite the first contact point when the cap member is in a opened configuration; and a pair of pivot portions for engaging the pivot recesses, the pivot portions rotatably supporting the hemispherical bowl for movement through an angle of about 180 degrees about an axis extending between the pivot recesses;

wherein in the closed configuration, the hemispherical bowl and quarter-spherical scoop align so that the passageway is obstructed by the hemispherical bowl and the mouth is obstructed by the cap assembly, and wherein in the opened configuration and configured to, the hemispherical bowl and quarter-spherical scoop align so that the passageway and the mouth of the container align to create an opening for dispensing the article from the container when inverted.

2. The cap assembly of claim 1 wherein the first contact point includes a depression for receiving the lip.

3. The cap assembly of claim 1 wherein the peripheral rim and the peripheral border are substantially coplanar when the cap member in the closed configuration.

4. The cap assembly of claim 1 wherein the cap assembly has a profile with a substantially flat top surface when in the closed configuration, the profile being convex when the cap assembly is in the opened configuration.

5. The cap assembly of claim 1 wherein an interior surface of the quarter-spherical scoop comprises a groove between the edge of the quarter-spherical scoop and the passageway.

6. The cap assembly of claim 1 wherein the hemispherical bowl comprises one-half of a dome.

7. The cap assembly of claim 1 wherein the edge of the hemispherical bowl comprises a flared extension.

8. The cap assembly of claim 1, the passageway located substantially on one side of the axis extending between the pivot recesses.

9. A cap assembly for dispensing an article from a container, comprising:

a body member for being reversibly and sealably mounted over a mouth the container comprising:

a peripheral rim for fitting onto the container;

a skirt depending substantially perpendicular from an exterior edge of the peripheral rim, the skirt for engaging the container;

a concave recess depending from an interior edge of the peripheral rim, the concave recess partially blocking the mouth and having a passageway communicating with an interior of the container; and a pair of pivot recesses located at diametrically opposite points on an edge of the concave recess; and a cap member comprising:

a concave bowl nested within the concave recess when the container is in an upright storage position, the concave bowl substantially not contacting the concave recess when the container is in an inverted dispensing position;

a peripheral border around an edge of the concave bowl, the peripheral border including a protruding lip, the lip contacting the peripheral rim at a first contact point when the container is in the upright storage position and engaging the peripheral rim at a second contact point substantially diametrically opposite the first contact point when the container is moved to the inverted dispensing position; and a pair of pivot portions for engaging the pivot recesses, the pivot portions rotatably supporting the concave recess for rotational movement about an axis extending between the pivot portions;

wherein the container in the upright storage position effects an engagement between the peripheral border and the peripheral rim with the lip contacting the first contact point, the concave bowl obstructing the passageway; and wherein the container in the inverted dispensing position effects an engagement between the lip and the second contact point, and positions the concave recess so that the passageway provides an opening between the interior of the container and the interior surface of concave bowl for dispensing the article from the container.

10. The cap assembly of claim 9 wherein the concave recess has a compartment into which the article is receivable by movement of the container from the upright storage position to the inverted dispensing position.

11. The cap assembly of claim 10 wherein the article is accessible to a user by movement of the container from the inverted dispensing position to the upright storage position.

12. The cap assembly of claim 9 wherein the movement of the container is a rotational movement.

13. The cap assembly of claim 9 wherein the peripheral rim includes a receiving portion configured to accept the protruding lip.

14. The cap assembly of claim 9 wherein the cap member has a profile with a substantially flat top surface when the lip contacts the peripheral rim at the first contact point.

15. The cap assembly of claim 9 wherein the cap member has a profile with a substantially flat top surface when the lip contacts the peripheral rim at the first contact point, the profile being convex when the lip engages the peripheral rim at the second contact point.

16. The cap assembly of claim 9 wherein the concave bowl comprises a groove.

17. The cap assembly of claim 16 wherein the concave recess comprises a ridge that engages the groove.

18. The cap assembly of claim 9 wherein the concave bowl comprises an extension flaring away from the peripheral rim.

19. The cap assembly of claim 9, the first contact point located between the pivot portions.

20. The cap assembly of claim 9, wherein an edge of the passageway is defined by a portion of an interior edge of the peripheral rim.

* * * * *